US005729657A

United States Patent [19]

Svensson

[11] Patent Number: 5,729,657

[45] Date of Patent: Mar. 17, 1998

[54] TIME COMPRESSION/EXPANSION OF PHONEMES BASED ON THE INFORMATION CARRYING ELEMENTS OF THE PHONEMES

[75] Inventor: Tomas Svensson, Stockholm, Sweden

[73] Assignee: Telia AB, Farsta, Sweden

[21] Appl. No.: 834,391

[22] Filed: Apr. 16, 1997

Related U.S. Application Data

[63] Continuation of Ser. No. 345,750, Nov. 22, 1994, abandoned.

[30] Foreign Application Priority Data

Nov. 25, 1993 [SE] Sweden ..... 9303902

[51] Int. Cl.[6] ..... G10L 5/04

[52] U.S. Cl. ..... 395/2.76; 395/2.73

[58] Field of Search ..... 395/2.67, 2.69, 395/2.73, 2.76

[56] References Cited

U.S. PATENT DOCUMENTS

| | | | |
|---|---|---|---|
| 3,158,685 | 11/1964 | Gerstman et al. | 179/1 |
| 3,632,887 | 1/1972 | Leipp et al. | 179/1 SA |
| 3,704,345 | 11/1972 | Coker et al. | 179/1 SA |
| 4,214,125 | 7/1980 | Mozer et al. | 179/1 SM |
| 4,435,831 | 3/1984 | Mozer | 381/30 |
| 4,692,941 | 9/1987 | Jacks et al. | 381/52 |
| 4,700,393 | 10/1987 | Masuzawa et al. | 381/51 |
| 4,701,937 | 10/1987 | Wan et al. | 375/25 |
| 4,802,221 | 1/1989 | Jibbe | 381/34 |
| 4,817,161 | 3/1989 | Kaneko | 381/51 |
| 4,833,718 | 5/1989 | Sprague | 381/52 |
| 4,864,620 | 9/1989 | Bialick . | |
| 4,896,359 | 1/1990 | Yamamoto et al. | 381/52 |
| 5,216,744 | 6/1993 | Alleyne et al. . | |
| 5,327,498 | 7/1994 | Hamon | 381/51 |
| 5,369,730 | 11/1994 | Yajima | 395/2.76 |
| 5,479,564 | 12/1995 | Vogten et al. | 395/2.76 |

FOREIGN PATENT DOCUMENTS 0 392 049 10/1990 European Pat. Off. .

OTHER PUBLICATIONS

Parsons, "Voice and Speech Processing," McGraw–Hill, Inc., New York, p. 284, 1987.

*Primary Examiner*—Allen R. MacDonald
*Assistant Examiner*—Robert C. Mattson
*Attorney, Agent, or Firm*—Oblon, Spivak, McClelland, Maier & Neustadt, P.C.

[57] ABSTRACT

The present invention relates to a method and arrangement for transforming phonemes over a shorter or longer time than an existing phoneme. The transformation takes place asymmetrically in that a basic phoneme is divided into a number of points, the said points being identified with respect to information-carrying elements in the phoneme. This provides a weighting in the phoneme between information-carrying elements and elements carrying less information. The parts of the phoneme which elements carrying less information are transformed over a longer or, respectively, shorter time interval. Elements in the phoneme which represent information-carrying parts are transferred unchanged in time. This provides a transformation of the phoneme which retains its original character in all essentials.

By the parts of the phoneme carrying less information being identified, the invention also provides an indication of where different phonemes can be fitted into one another in the creation of artificial speech.

10 Claims, 3 Drawing Sheets

TIME COMPRESSION/EXPANSION OF PHONEMES BASED ON THE INFORMATION CARRYING ELEMENTS OF THE PHONEMES

This application is a Continuation of application Ser. No. 08/345,750, filed on Nov. 22, 1994, now abandoned.

TECHNICAL FIELD

The present invention relates to speech synthesis. In speech synthesis, words are identified which are broken down into a number of characteristic sounds called phonemes. In identifying spoken sequences, it is essential that the said phonemes are identified correctly. The phonemes are also utilized in generating spoken sequences by artificial means.

STATE OF THE ART

When speech is artificially generated, a library with fundamental phonemes is normally utilized. When these phonemes are assembled into words, they must in many cases be transformed over longer or shorter periods of time than are represented by the basic phoneme. It is known in this connection to identify the phoneme at a number of points. When transforming the original phoneme to a different timescale, which can represent lengthening or shortening of the timescale, it is known to carry out the transformation at a number of selected points. When the timescale is lengthened, this involves certain points in the original phoneme representing a number of points in the new phoneme. When the timescale is shortened, a number of selected points in the original phoneme are combined to form one point in the new phoneme. When the original phoneme is transferred to a timescale which, for example, is 25% longer than the phoneme in the library, a number of points in the library phoneme are selected. In the new phoneme, which is formed by the transformation, 25% more points are inserted than in the library phoneme. On transformation, the new phoneme will therefore contain a number of points which are not defined in the library phoneme. On transformation, every fourth point in the library phoneme is selected. These parts of the phoneme are duplicated and transferred to two points in the lengthened phoneme. The remaining points are transferred from the library phoneme to the lengthened phoneme point by point. This provides a lengthening in time of the original phoneme by means of an even time-lengthening over the entire phoneme. In those cases where the library phoneme is longer than the phoneme which has to be formed, every fourth point is selected in the same manner as above, assuming that the shortening of time is 25%. When the time-shortened phoneme is formed, these points are removed in the transformation. In Patent EP 252544, speech scale modification of a new signal point is described. This is based on, inter alia, the finding that timescale compression reduces the information content and timescale expansion increases the information content. Thus, "pitch periods" can be removed or inserted, respectively, over a segment. The invention constitutes a method for improving the SOLA method by superimposition of partially overlapping blocks.

U.S. Pat. No. 4,435,832 shows speech synthesis with lengthening and compression of the timescale without changing the pitch of the synthetic speech. LPC parameters are sampled from segmented wave forms taken out from natural speech at a given time interval, from information about voiced/unvoiced phonemes, pitch and volume information. LPC is interpolated and the timescale interval for interpolation is improved.

In U.S. Pat. No. 4,864,620, a method is described for timescale modification of speech information or speech signals in order to reproduce recorded speech at a different speed without changes in pitch. Timedomain samplings are taken in frames where the number of samplings per frame is a function of the desired speech changing factor. Blocks are formed from the frames. Relatively soft transitions are produced by graded weighting.

Timescale modification of speech signals is also specified in U.S. Pat. No. 5,216,744. The number of samplings which constitute one "pitch period" is determined. Furthermore, a combined sample group formed of a first sample group and a second sample group is formed. The number of samples in each group is equal to the number of samples which constitute one pitch period.

DESCRIPTION OF THE INVENTION

TECHNICAL PROBLEM

In speech synthesis, it is essential that words and sentences which are produced artificially are reproduced naturally. It is also essential that speech produced by a person is identified in a correct manner. In the connection, it is possible to identify a number of characteristic sounds, phonemes, for different languages. These phonemes are arranged in different forms of libraries. The said phonemes constitute a basic nucleus. The phonemes can extend over a longer or shorter time than the time intervals which are represented by the basic phoneme in dependence on which context and in which words they are included. This implies that the phonemes which are represented in the library must be transformed into longer or shorter time periods. In this context, it is essential in such transformations that the characteristic of the phoneme is not changed. This implies that the information-carrying parts of the phoneme ought not to be changed. It is thus desirable that time changes occur in the parts of the phoneme which carry less information. In assembling a number of phonemes into words and sentences, it is also essential that the transitions between phonemes take place in such a manner that the information-carrying parts of a respective phoneme are not changed.

In natural speech, the fundamental tone is changed within one and the same phoneme in the progress of speech. The solutions which have hitherto been presented have not taken this phenomenon into account. It is thus desirable that the change in the fundamental tone, higher or lower frequency, is taken into consideration when transforming phonemes.

The characterized invention is intended to specify a solution to the characterized problem.

SOLUTION

The present invention relates to a method in speech synthesis. A phoneme is identified, for example in a number of points in the corresponding vocal cord excitation of the speaker. The phoneme must be transformed to another time than that which is represented by the original phoneme. After the points have been selected, the points in the phoneme which are information-carrying are identified. Information-carrying in this connection means the parts in the phoneme which are required for the phoneme to be correctly understood. The parts of the phoneme which carry less information are also identified. Parts which carry less information can be changed without the characteristic of the phoneme being changed in its most essential part. When phonemes are used, for example in generating artificial speech, it is desirable that a number of basic phonemes can be utilized which are transformed to desired values on different occasions. The invention takes account of this situation and moves the transitions between different phonemes to the parts which carry less information. When transforming to a new timescale, compression or, respectively, stretching essentially takes place in the parts of the phoneme carrying less information. In this manner, the information-carrying parts of the phoneme are kept essentially intact.

The arrangement comprises an element which selects a phoneme from a spoken sequence or from a storage element. The element identifies a number of points in the phoneme. After that, the information-carrying parts of the phoneme or, respectively, the parts of the phoneme carrying less information, are identified. The element then takes care that transformation of the phoneme over a longer/shorter time takes place by compression or, respectively, stretching in the parts of the phoneme carrying less information. In this manner, the character of the phoneme is essentially retained. Furthermore, a possibility is given of obtaining transitions between different phonemes which provide a natural impression.

The invention permits the storage of a set of library phonemes representing a number of standard sounds which are found in the language. These library phonemes can then be utilized for transformation over a longer or shorter time than is represented by the library phoneme. With the solution specified, the transformed phoneme is minimally corrupted in relation to the library phoneme. This is due to the fact that the parts of the phoneme which are essential to the interpretation of the phoneme are unchanged or changed to a lesser degree. The invention also allows account to be be taken of changes in the fundamental tone in the phoneme. It is thus allowed that variations in the fundamental tone can be introduced into the transformed phoneme in relation to the library phoneme. The significance of this is that created speech sequences can be given a character which accords with natural speech. This is essential, partly for understanding the speech and partly for obtaining a natural intonation in the created sound.

PREFERRED EMBODIMENT

Figure 1:
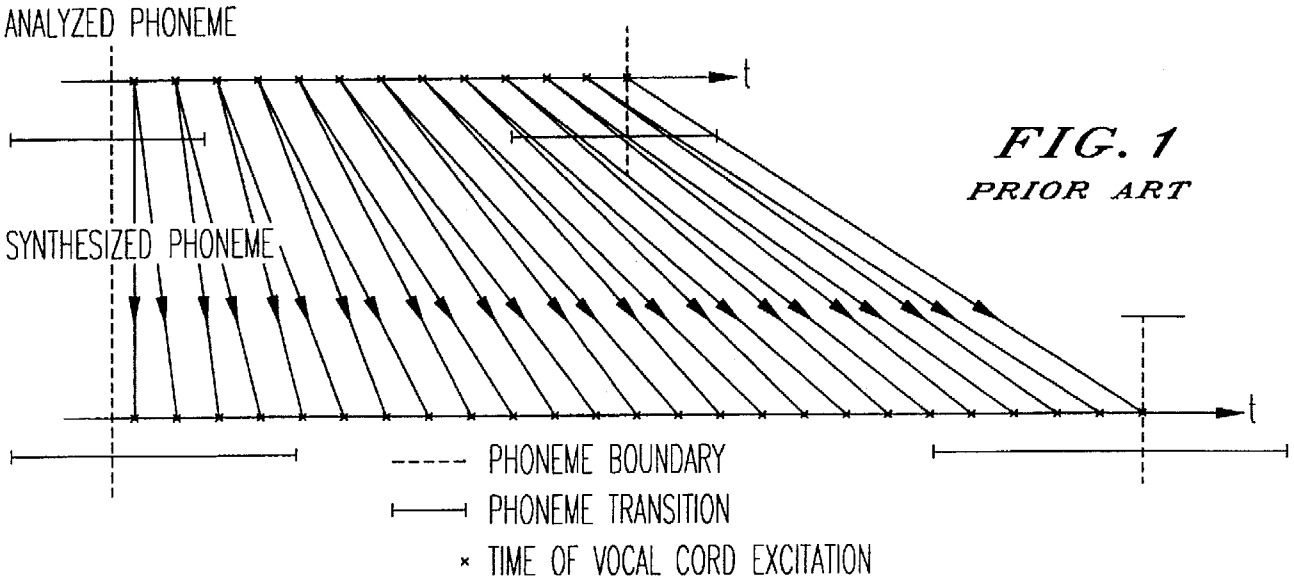
FIG. 1 PRIOR ART
FIG. 1 shows examples of linear timescale mapping.
Figure 2A:
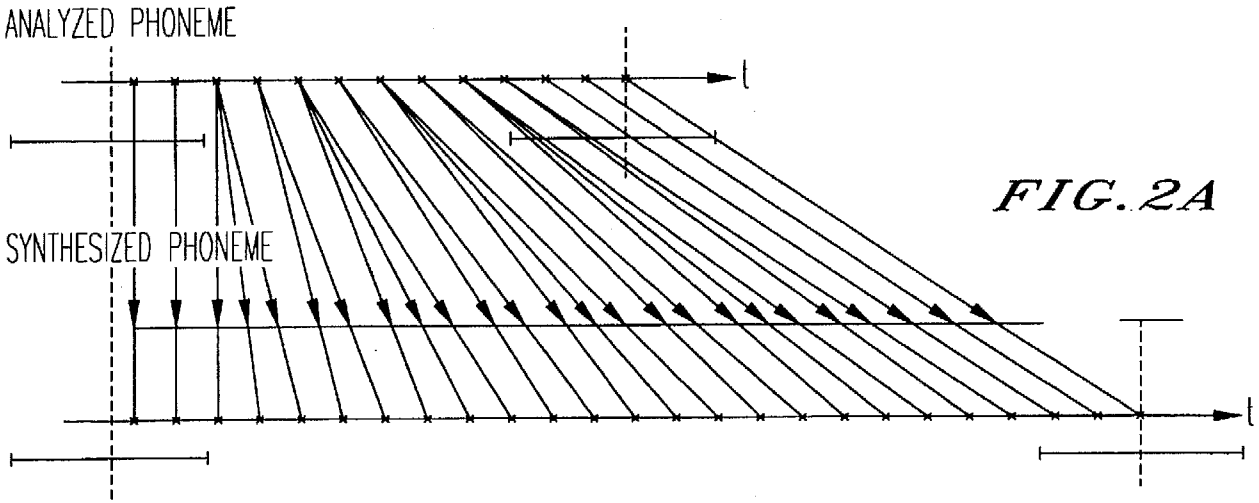
FIG. 2A shows timescaling according to the invention.

In the text which follows, the invention is described with respect to the figures. When creating an artificial speech, a text arrives at 1 in FIG. 3. The text is analyzed by 1 and broken down into its fundamental components. After that, the phonemes are selected from the library. The phoneme in the library represents a standard value. This implies that the phoneme has been given a standard value with respect to duration, pitch and so forth. When the phoneme is then to be inserted into the text which has arrived, some form of modification of the phoneme is required as a rule. This means that the extension of the phoneme in time has to be changed. This is represented, for example, by long, short or medium-length times during which, for example, a vowel has to be represented. In order to transform the library phoneme, it is identified at a number of points. The phoneme is then analyzed by 1. In the analysis, information-carrying parts and parts carrying less information are determined. The parts carrying less information are then selected for the transformation. It has been observed that the transitions between different phonemes are of greater significance than the more stable parts in the interior of the phonemes. The building-up (construction of phoneme sequences) process, which contains decisive information relating to the interpretation of the phoneme, is of particular importance in this context. The points carrying less information are then copied to a number of equivalent points in the new timescale when prolonging the time. This is illustrated in FIG. 2 where certain points from the shorter timescale are transferred to a number of points in the longer timescale. In this manner, the information-carrying parts of the phoneme are retained in the stretching of the timescale without the characteristic of the phoneme being changed.

The timescale is shortened in a corresponding manner. In this case, two or more points in the part of the phoneme not carrying information are combined to form one point. In this manner the information-carrying parts are also largely retained intact when the timescale in the phoneme is shortened.

Figure 4B:
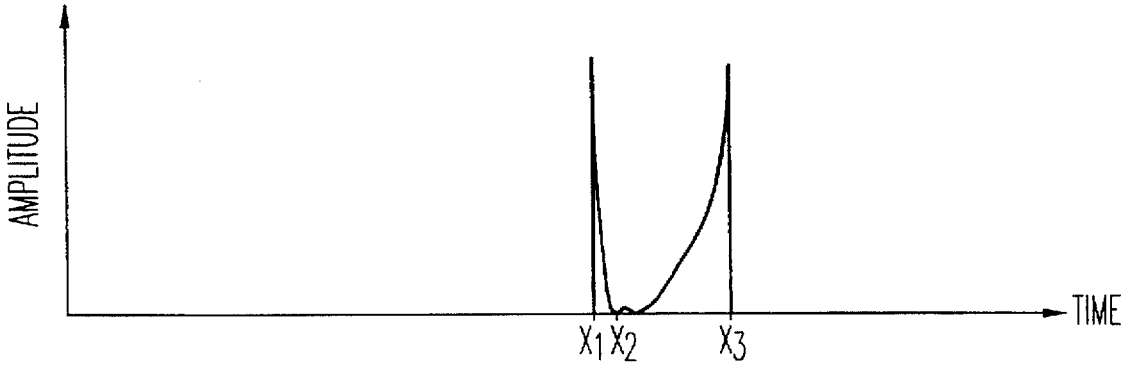
FIG. 4B shows which portion of the vocal cord excitation waveform is asymmetrically cut out by a window function.
Figure 4A:
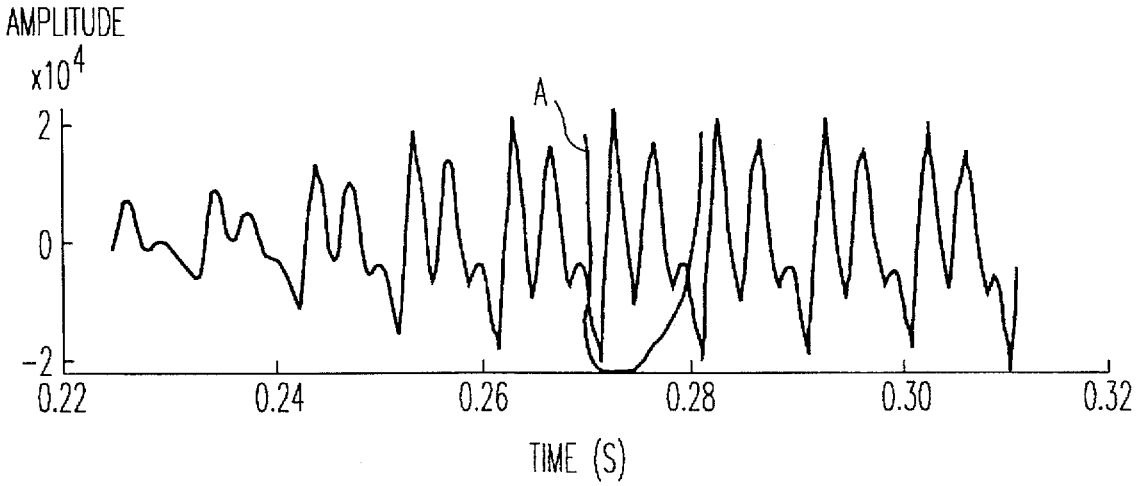
FIG. 4A shows a phoneme in which a window A cuts out a pulse asymmetrically.

To reduce the effect of a preceding vocal cord excitation, a window has been selected which has been cut out asymmetrically. FIGS. 4A and 4B show which portion of the vocal cord excitation waveform is "cut out" so individual vocal cord excitations can be distinguished from one another. The window which is not expressly shown in FIGS. 4A or 4B can be readily developed by one of ordinary skill in the signal processing art in light of the "cut out" portion of the waveform shown in FIGS. 4A and 4B. Nonetheless, as is evident from the "cut out" portion, the portion of the vocal cord excitation waveform that is extracted for later analysis is thus cut steeply at the beginning thereby recording the initial period of the pulse as shown by time $X_1$ in FIG. 4B and a minimum part of the end part of the preceding pulse. Also as is evident from the "cut out" portion shown in FIGS. 4A and 4B, by asymmetrically cutting out the pulse so that the pulse's maximum value, near $X_2$, is preserved, the remaining portion of the pulse is damped. Consequently, the window acts to preserve the main portion of the pulse because the present inventor has determined contains more significant information than the damped or deemphasized portion of the pulse, which carries less significant information. By extracting specific vocal excitations using the above-described window, at least two benefits are recognized that are relevant to the present invention. First, by cutting out individual pulses in the above-described manner, the individual pulses are available for further analysis in characterizing an individual phoneme or phoneme boundary. Second, the damped portion of the pulses signify a region where little information is carried by the pulse, and thus, create more room, if needed, for moving transitions between individual vocal cord excitations during a time scale transformation operation.

The invention also permits different points in the library phoneme to be weighted in relation to the information-carrying elements. The weighting is utilized in the transformation of the phoneme in such a manner that the points which have been given a lower weighting are transformed over a longer time period than the parts which have received higher weighting. Thus, points with low weighting are allocated to, for example, three points in a longer timescale while points which represent a medium weighting are transformed, for example, to two points in the new timescale and points with highest weighting are transferred unchanged into the new scale.

On transformation to a shorter timescale than that which is represented in the basic phoneme, three points, for example, which represent the lowest weighting are combined into one point in similar manner and points which represent medium weighting are combined in twos into one point in the time-shortened phoneme. Points with the highest weighting are transferred unchanged into the new timescale.

In this manner, the invention makes it possible for timescaling of phonemes to be be carried out without the information-carrying parts of the phoneme being changed in any essential way. The method also permits different phonemes to be linked together in such a manner that important information in the phonemes is not destroyed at the phoneme transitions. This is brought about by the transition between the phonemes taking place in parts which do not carry any information. In this manner, the invention permits words and expressions which are created via speech synthesis to become almost natural.

Figure 2B:
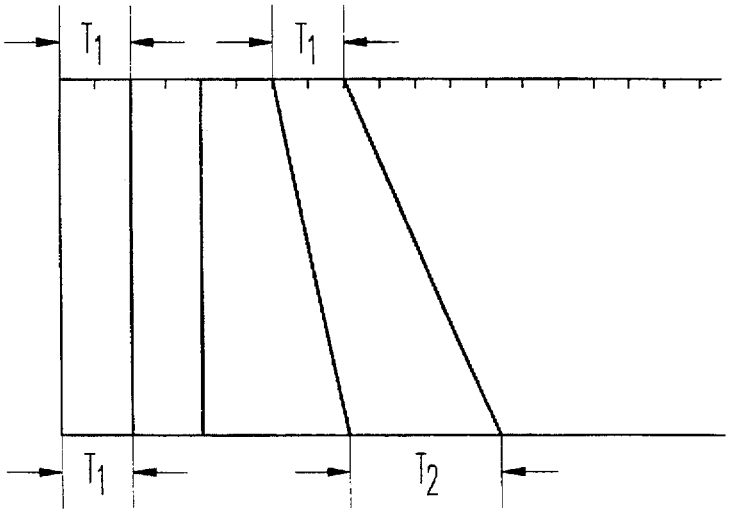
FIG. 2B is a graph showing a time scaling with a change in frequency.
Figure 3:
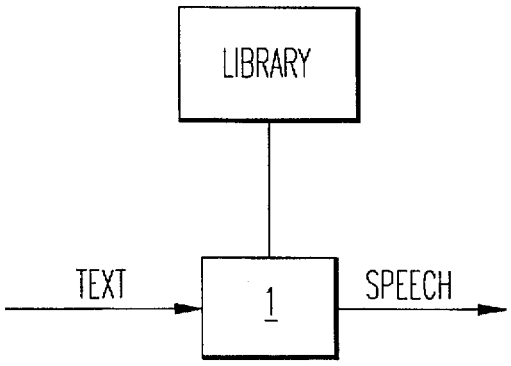
FIG. 3 shows the invention in block diagram form.

Due to the fact that the points selected in the phoneme represent vocal cord excitations in the speech, it is possible to change the fundamental tone. This is necessary, for example, in order to give the phoneme which is being created the right character. The change of the fundamental tone is obtained by the vocal cord excitations in the created phoneme being reproduced at points which are changed in relation to the original phoneme. Let it be assumed, for example, that the basic phoneme represents a sound with unchanged fundamental tone. This implies that the vocal cord excitations occur with the same spacing between themselves. In a transformed phoneme, however, the fundamental tone is changed during the duration of the phoneme. With knowledge of the change in the fundamental tone characteristic, account must be taken of this in the transformation. In the new phoneme, which in this case can be a phoneme which is unchanged in time or is transformed to a longer or shorter time, the time intervals are determined between each vocal cord excitation which is to appear in the phoneme. Thus, for example as shown in FIG. 2B, the time interval between the first and the second vocal cord excitation is T1 and the interval between the last and last-but-one vocal cord excitation is T2 determined. If, in this case, it occurs that the alteration in the fundamental tone changes uniformly over time, the intermediate vocal cord excitations must be distributed while taking this into consideration. The said distribution is suitably carried out by means of known mathematical models. Respective vocal cord excitations in the basic phoneme are then transferred to respective points in the transformed phoneme. This provides a variation in the fundamental tone which corresponds to natural speech.

The invention is not limited to the embodiment shown above but can be subjected to modifications within the scope of the subsequent patent claims and concept of the invention.

What is claimed as new and is desired to be secured by Letters Patent of the United States is:

1. A speech-synthesis method for transforming a phoneme from a first timescale to a second timescale, comprising the steps of:

determining a set of points indicative of said phoneme;

identifying a first part of said set of points occurring at a boundary of said phoneme and having a first amount of information uniquely characterizing said phoneme, said first part corresponding to a first period in said first timescale;

identifying a second part of said set of points occurring at an interior of said phoneme and having a lesser amount of information than said first part, said second part corresponding to a second period in said first timescale;

transforming said second part to said second timescale to create a transformed second part having a third period that is different than said second period; and transforming said first part to said second timescale to create a transformed first part having a fourth period that is equivalent or nearly equivalent to said first period so as to retain said information carried by said first part not carried by said second part.

2. The method of claim 1, further comprising the steps of:

determining an amount of said information carried by respective of said set of points; and weighting respective of said set of points based on said amount of information carried by said respective of said set of points.

3. The method of claim 2, wherein:

said step of weighting comprises weighting said second part with respective lower weighting values than said first part; and said step of transforming said second part comprises, duplicating a first portion of said second part of said set of points when said second timescale is longer in duration than said first timescale, and removing a second portion of said second part of said set of points when said second timescale is shorter in duration that said first timescale.

4. The method of claim 1, further comprising:

combining said phoneme with another phoneme, comprising, identifying a part of said another phoneme which carries nearly no information, and transitioning from said phoneme to said another phoneme at said part of said another phoneme which carries nearly no information.

5. The method of claim 1, wherein:

said step of determining a set of points indicative of said phoneme comprises determining a fundamental tone of said phoneme; and said step of transforming said second part comprises transforming said second part to said second timescale only when a duration of said first timescale does not equal a duration of said second timescale thereby retaining said fundamental tone.

6. A speech synthesis system that transforms a phoneme from a first timescale to a second timescale, comprising:

a selection element configured to select said phoneme from at least one of a speech sequence or a storage device;

a determination mechanism configured to determine a set of points indicative of said phoneme, said determination mechanism comprising, a first identification mechanism that identifies a first part of said set of points occurring at a boundary of said phoneme and having a first amount of information uniquely characterizing said phoneme and corresponding to a first period in said first timescale, and a second identification mechanism that identifies a second part of said set of points occurring at an interior of said phoneme having a lesser amount of information than said second part and corresponding to a second period in said first timescale;

a first transforming mechanism that transforms said second part to said second timescale to create a transformed second part having a third period that is different than said second period; and a second transforming mechanism that transforms said first part to said second timescale to create a transformed first part having a fourth period equivalent or nearly equivalent to said first period so as to retain information carried by said first part not carried by said second part.

7. The system of claim 6, wherein said selection element is configured to determine an amount of said information carried by respective of said set of points, and is configured to weight respective of said set of points based on said amount of information carried by respective of said set of points.

8. The system of claim 7, wherein:

said selection element weights said second part with respective lower weighting values than said first part, and weights with medium weights a third part of said set of points carrying more information than said second part but less than said first part; and said first transforming mechanism is configured to transform said second part over a longer timescale than said third part, and transform said third part over a longer timescale than said first part.

9. The system of claim 7, wherein:

said selection element weights said second part with respective lower weighting values than said first part, and weights with medium weights a third part of said set of points carrying more information than said second part but less than said first part; and said first transforming mechanism is configured to transform three points of said second part into a corresponding single point, and transform two points of said third part over a timescale that is shorter in duration than said first part.

10. The system of claim 6, wherein:

said selection element determines a fundamental tone of said phoneme based on said set of points; and said first transforming mechanism is configured to change said fundamental tone only when said second timescale is different than said first timescale.

* * * * *